United States Patent [19]

Cuthbertson et al.

[11] 4,240,209

[45] Dec. 23, 1980

[54] METHOD OF AND APPARATUS FOR DRYING GRAIN AND THE LIKE

[76] Inventors: Earl A. Cuthbertson, 309 N. Broadway; Bobbie G. Cuthbertson, R.R. #2, both of Toledo, Iowa 52342

[21] Appl. No.: 916,945

[22] Filed: Jun. 19, 1978

[51] Int. Cl.[3] ..... F26B 3/00; F26B 17/00

[52] U.S. Cl. ..... 34/10; 34/28; 34/31; 34/33; 34/74; 34/166; 34/182

[58] Field of Search ..... 34/10, 28, 31, 33, 74, 34/57 D, 166, 182; 432/91

[56] References Cited

U.S. PATENT DOCUMENTS

| | | | |
|---|---|---|---|
| 333,939 | 1/1886 | Foote | 34/66 |
| 546,830 | 9/1895 | Smith | 34/28 X |
| 1,254,770 | 1/1918 | Bromley | 34/166 |
| 1,534,737 | 4/1925 | Reed | 34/31 X |
| 3,905,127 | 9/1975 | Davis | 34/182 |

*Primary Examiner*—John J. Camby

*Attorney, Agent, or Firm*—Haven E. Simmons; James C. Nemmers

[57] ABSTRACT

A grain dryer employs an auger assembly featuring a hollow auger shaft through which hot water is circulated to heat the auger flighting and thus the grain. The water emerging from the auger shaft is then used to heat atmospheric air supplied by a blower, which air is then injected into the grain through a set of ports along the auger housing. The injected air entrains moisture expelled from the grain by the hot auger and exits from the auger housing through another set of ports along the latter.

20 Claims, 3 Drawing Figures

FIG 4
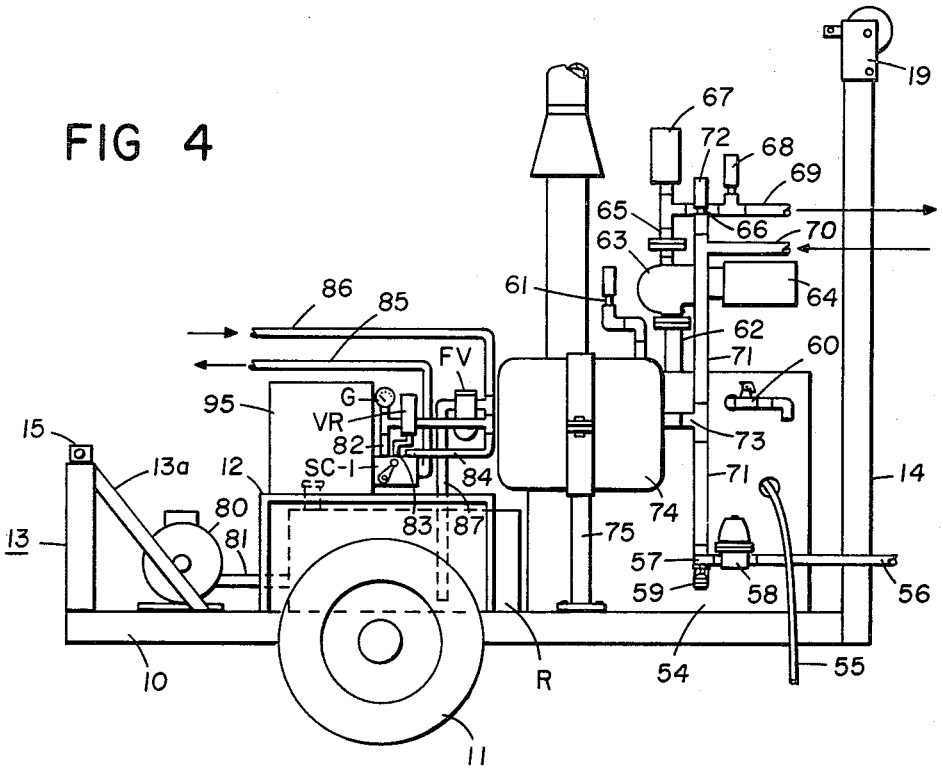
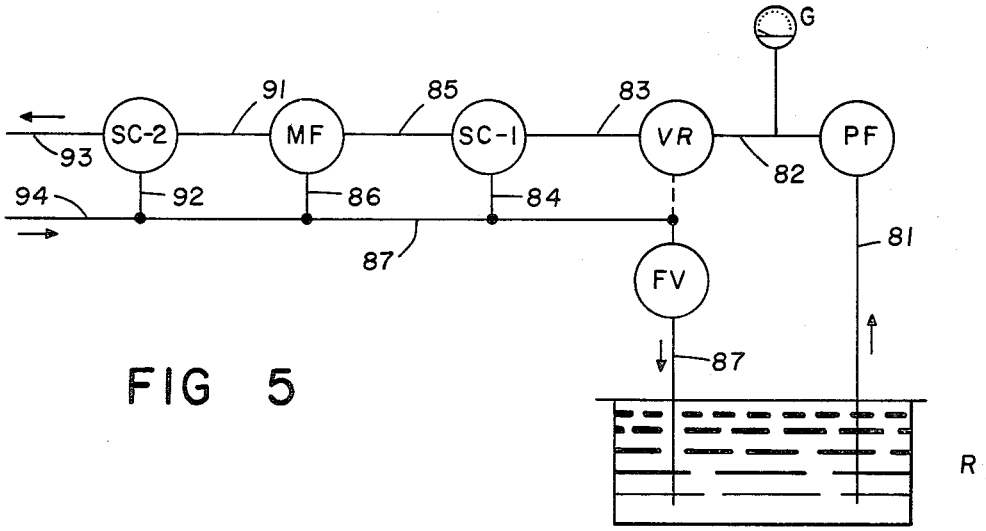
FIG 5

METHOD OF AND APPARATUS FOR DRYING GRAIN AND THE LIKE

BACKGROUND OF THE INVENTION

Frequently it is necessary to remove excess moisture from grain such as corn, wheat, soybeans and others prior to their storage. Currently, the conventional method of doing so is by drying the grain in large, gas-fired apparatus and then conveying it into bins for storage. That apparatus typically consists essentially of a large, horizontally positioned drum, perforated around its peripheral wall, through which hot air and gases from an LP gas burner are driven by a fan. The grain is fed into the upstream end (with respect to the direction of heat flow) of the drum and transported through the latter by a suitable conveyor. The resulting contact between the grain and the heat expels moisture from the grain which together with the heat is exhausted to the atmosphere through the perforations in the drum.

Obviously, this arrangement is very prodigal of heat since so much of the latter is irretrievably lost once it is exhausted from the drum. The growing shortages of fuels and their rising costs argue for some other, less wasteful manner of drying grain in the circumstances concerned. The primary object of the present invention, therefore, is an apparatus, as well as a method, which can efficiently and yet relatively inexpensively dry grain prior to its storage.

SUMMARY OF THE INVENTION

The invention employs a grain auger having a hollow auger shaft driven by a variable speed hydraulic motor. Grain is introduced into one end of the auger housing and discharged from the other. During passage of the grain through the auger housing a heated liquid is passed through the auger shaft in order to heat it and the auger flighting sufficiently so that moisture is expelled from the grain as it contacts the auger. The liquid leaving the shaft, which is still well above atmospheric temperature, is then led through a heat exchanger which transfers residual heat of the liquid to air ducted in from the atmosphere. The latter air, after being heated, is then injected into the auger housing through a row of inlet ports along the housing. That air then passes into the grain flowing through the auger housing, entraining the moisture driven from the grain by the heated auger, and together with the moisture exits from the auger housing through a row of outlet ports. Generally speaking, this is the method aspect of the invention, though conceivably means other than a hollow shafted auger could be used. Whatever will move and heat the grain, as well as keep the air injected into it warm so that it can carry off the expelled moisture, will do the job. A hollow shafted auger operating in an enclosed housing has simply proved the most feasible way for accomplishing this.

Apparatus-wise, beside the hollow shafted auger, the invention employs an LP gas fired furnace and boiler for supplying hot water to the auger shaft adjacent the grain inlet at one end of the auger housing. The water emerges from the auger shaft adjacent the grain outlet at the other end of the auger housing and is led in a conduit back along the exterior of the auger housing before being returned to the boiler. Surrounding that conduit and formed on the exterior wall of the auger housing is an air duct to which air is supplied by a blower near the grain outlet. After the air is heated by contact with the conduit, it is discharged from the duct near the grain inlet and fed into another duct formed on the exterior wall of the auger housing from which it passes into the latter through inlet ports spaced along the auger housing wall. The air is thus directed into the grain in the auger housing as it is being heated by the auger, picking up the moisture as it is driven out of the grain, and exits with the moisture to the atmosphere through outlet ports spaced along the auger housing wall but offset relative to the inlet ports. Preferably, the entire apparatus, including the furnace and boiler, a motor driven pump for circulating the water, a motor driven hydraulic pump and reservoir for the auger drive motor, and various controls, is carried on a wheeled platform so that it can be readily moved from bin to bin.

The foregoing accomplishes a very substantial reduction in the amount of fuel, and thus cost, necessary to dry grain sufficiently for storage, reducing its moisture content, which may be as high as 27% (by weight), to less than 13%, the latter currently being about the upper limit for grain to be stored. None of the heat is wasted in the sense that after the hot water has heated first the grain and then the air, it is returned to the boiler for reheating to the extent necessary before being recirculated through the grain and the air. Furthermore, any type of available fuel, such as wood, coal, kerosine, corn cobs, etc., can be used since the products of combustion never come in contact with the grain. This is in contrast to current dryers in which the products of combustion necessarily directly contact the grain and thus more or less must use clean burning propane which does not contaminate the grain as would kerosine, fuel oil, etc.

These are some of the unique features of the invention which distinguish it, so far as is known, from prior grain dryers for the purpose concerned. U.S. Pat. No. 333,939, it is true, does disclose a grain dryer utilizing a hollow shafted auger through which hot air is passed, while U.S. Pat. No. 546,830 shows a kind of "auger" through which steam or hot water passes for conditioning flour. Other U.S. patents display various uses of hot air, gases or products of combustion for grain drying. But, so far as is known, these disparate techniques have never been combined in as efficacious a manner as they are in the present invention. Other and further features and advantages of the latter will also become apparent from the drawings and the more detailed description which follows.

BRIEF DESCRIPTION OF THE DRAWINGS

FIG. 4 is a side elevation of the dryer, with the auger housing and components omitted, illustrating details of the water heating and hydraulic components.

FIG. 5 is a schematic diagram of the hydraulic circuitry of the dryer.

DETAILED DESCRIPTION OF THE PREFERRED EMBODIMENT

Figure 3:
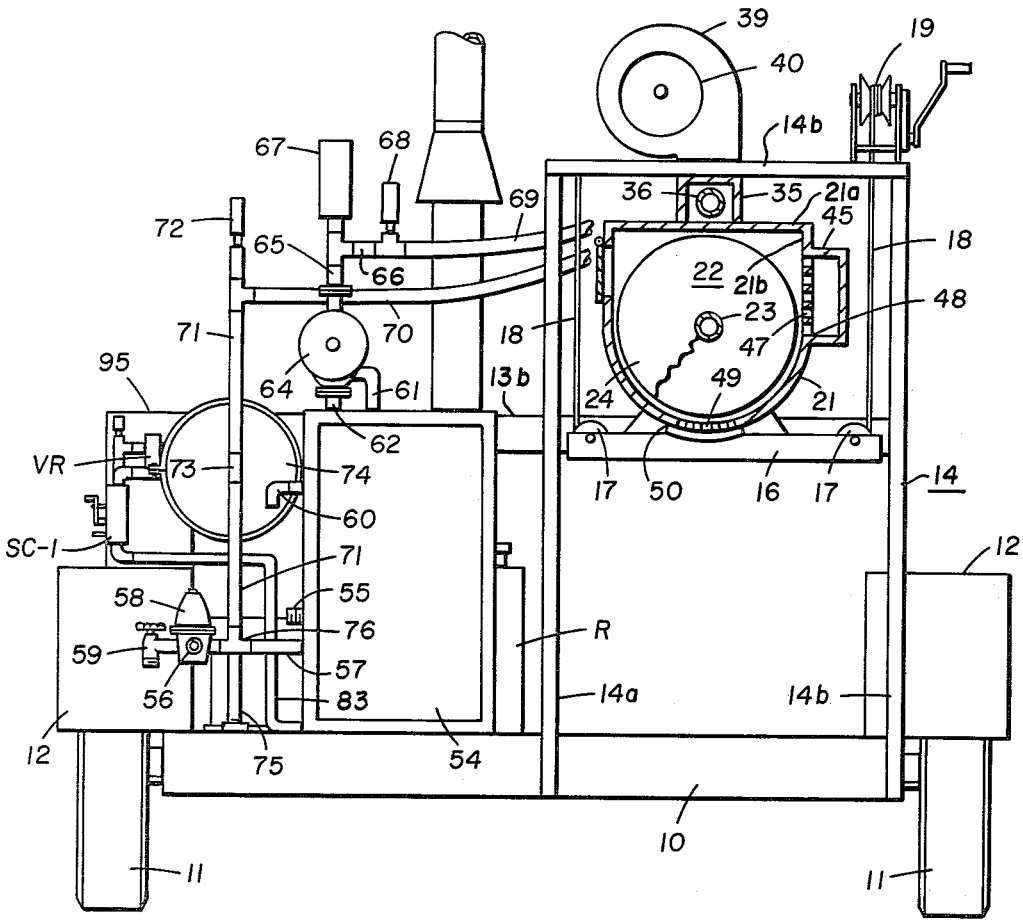
FIG. 3 is an end elevation, partly in section, taken along the line 3—3 of FIG. 1.

The invention will be described in detail from the standpoint of an actual working prototype which is portable for movement from bin to bin. For this purpose the dryer is mounted on a suitable rectangular platform 10 provided along its sides with a pair of rubber tired wheels 11 and fenders 12. Along the front edge of the platform 10 is erected a low, rectangular frame 13 of inverted "U" shape, suitably braced at 13*a*, and along a portion of the rear edge of the platform 10 adjacent a corner a similar frame 14 is erected but taller and narrower than the frame 13. The auger assembly, generally designated at 20, is pivoted at approximately its midpoint on trunnions 15 attached to the bottom of the auger housing 21 and the top frame member 13*b*. The auger assembly 20 extends rearwardly between the side frame members 14*a* and is cradled upon a transverse beam 16, attached to the bottom of the auger housing 21, whose ends carry a pair of pulley sheaves 17. A cable 18 (see FIG. 3), attached at one end to one end of the top frame member 14*b*, passes down through the sheaves 17 and up to a winch 19 mounted atop the other end of the top frame member 14*b*. Hence the auger assembly 20 can be adjusted by the winch 19 from the operative position shown in FIG. 1 to a horizontal position for transport.

The auger housing 21 is preferably "U"-shaped in cross-section and closed over by a top wall 21*a*. While a round auger tube could be used, the "U"-shaped housing 21 is cheaper and easier to fabricate and also permits greater grain capacity. The auger itself, generally designated at 22, is built up on a hollow auger shaft 23 to which double flighting 24 is welded for good heat conductivity between it and the shaft 23. Alternately, the flighting 24 might be attached by one of the newer heat conductive adhesives. In any event, the auger 22 operates in the trough of the housing 21 and the auger shaft 23 emerges from the ends of the housing 21 through suitable end closure plates 25 and hydraulic swivels 26. The flat top wall 21*a* of the auger housing 21 is rectangularly apertured at its upstream end to provide a grain inlet 27 which is fitted with a hopper 28, and the bottom wall of the housing 21 is similarly apertured at its downstream end to provide a grain outlet and chute 29. The exposed downstream end of the auger shaft 23 is fitted with a large drive sprocket 30 from which a drive chain 31 passes up over a smaller drive sprocket 32 on the shaft of a three port hydraulic drive motor MF of 19.2 $in^3$ displacement bolted to a base plate 33 secured to the housing top wall 21*a*. In the prototype concerned the auger housing 21 has an overall length of about 30 feet, the auger 22 is 10 inches in diameter with a 4½ inch pitch, and the ratio of the drive sprockets 30 and 32 is 3 to 1.

Along the auger housing top wall 21*a* is constructed a rectangular air duct 35 from plate material welded together edgewise and to the top wall 21*a*. The duct 35, which extends nearly the entire distance between the hopper 28 and the motor MF, is closed at its ends and spacedly surrounds a water conduit in the form of a length of copper pipe 36 which emerges from each end of the duct 35. Suitable pipe 37 connects the downstream end of the auger shaft 23 and the adjacent end of the pipe 36, the pipe 37 also carrying a temperature gauge 38. The adjacent end of the top wall of the duct 35 is apertured and a blower 39, having a 400 CFM capacity and driven by a motor 40, is mounted thereupon to discharge air entering at 41 from the atmosphere into and along the duct 35 in heat exchange with the pipe 36. A second rectangular air duct 45, approximately co-terminus with the duct 35, is similarly constructed along one of the auger housing side walls 21*b* and a hose 46 between their adjacent ends connects the two ducts 35 and 45 so that air from the former is led into the latter. The housing side wall 21*b* within the duct 45 is rectangularly apertured at spaced locations therealong, 8 being shown, and fitted with screens 47 (only one being shown) to provide hot air inlet ports 48 into the interior of the housing 21. In order to remove the air and entrained moisture from the housing 21, the bottom of the latter is also apertured at spaced locations between adjacent inlet ports 48 and also fitted with screens 49 (one being shown in FIG. 3) to provide air outlet ports 50. The screens 47 and 49 are fine enough to bar passage of grain kernels from within the housing 21 and may consist of relatively thin plate material perforated with 3/32" holes and welded in position.

Hot water is supplied by a conventional furnace and boiler 54, a suitable one being a Weil-McLain unit having an 84,000 BTU output and propane fired, the latter being supplied through a line 55 connectable to a typical propane supply tank (not shown). As previously noted, however, since any type of available fuel can be used to heat the boiler, some other appropriate furnace could be substituted. In any event, water is supplied to the boiler through pipes 56 and 57 and a pressure regulator 58 incorporating a boiler drain valve 59. From the boiler, which includes an overflow relief valve 60 and a pressure relief valve 61, the hot water supplied to the auger assembly 20 passes through a pipe 62 to a pump 63 driven by a motor 64, thence through pipes 65 and 66 incorporating a thermostatic control 67 for the furnace 54 and a pressure relief valve 68, and finally through a hose 69 running alongside the auger housing 21 and connected into the exposed upstream end of the auger shaft 23 at the hydraulic swivel 26. The hot water thereafter is circulated through the auger shaft 23, then through the pipe 37, and thence to and through the pipe 36 in the duct 35. From the downstream end of the pipe 36 the water is returned from the auger assembly 20 to the furnace 54 through a hose 70 alongside the hose 69 connected into the top of a vertical return pipe 71 adjacent the furnace 54 and fitted at its upper end with a relief valve 72. Below the latter valve the return pipe 71 is teed at 73 into an expansion tank 74, supported on a stanchion 75, and at its lower end is teed at 76 into the water supply line 57 for return to the boiler.

The hydraulic drive for the auger assembly 20 consists of a fixed displacement hydraulic pump PF having a 1,800 psig capacity and a 3 h.p. pump drive motor 80 disposed on the platform 10, the pump PF drawing from a 12–14 gallon reservoir R of hydraulic fluid through a line 81. A line 82, in which a pressure gauge G is interposed, leads from the output of the pump PF to a 1,000 psig pressure relief valve VR and thence through a line 83 to an auger speed control valve SC-1 which bypasses excess fluid through a line 84. The output of the valve SC-1 is taken by a line 85 running alongside the auger housing 21 to the inlet port of the auger drive motor MF. Fluid from one outlet port of the motor MF is returned through a line 86 along the housing 21. The lines 84 and 86 empty into a common return line 87 which in turn empties into the reservoir R through a filter FV. In order to provide drive for a separate bin auger 90, the hydraulic system may also include a line 91 from the other outlet port of the motor MF to a second auger speed control valve SC-2, also of the bypass type through a line 92 tied into the common return line 87. Lines 93 and 94, equipped with quick disconnects, thence lead to and from the drive motor (not shown) of the bin auger 90, the line 94 also being tied into the common return line 87. The valves SC-1 and VR, the gauge G and their associated plumbing are all mounted atop one fender 12 while the valve SC-2 is mounted on the base plate 33 adjacent the motor MF. Electric power for the blower and pump motors 40, 64 and 80, as well as for the furnace 54, lighting, etc., is supplied from a central junction box 95 also mounted atop the fender 12. The electrical circuitry involved is wholly conventional and accordingly is unnecessary to illustrate or further describe.

Figure 1:
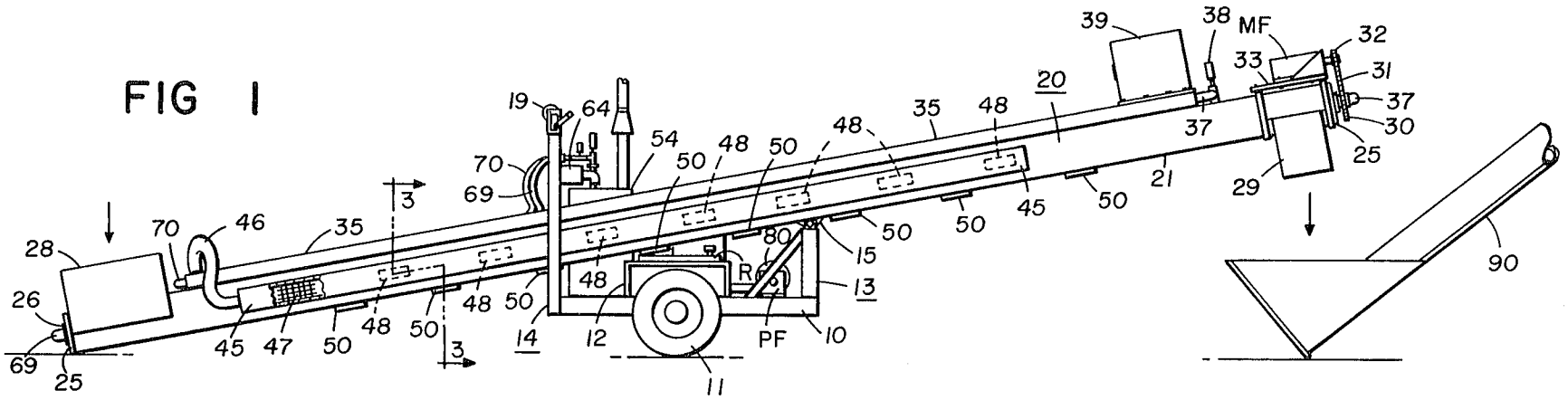
FIG. 1 is a side elevation of a grain dryer according to the invention.
Figure 2:
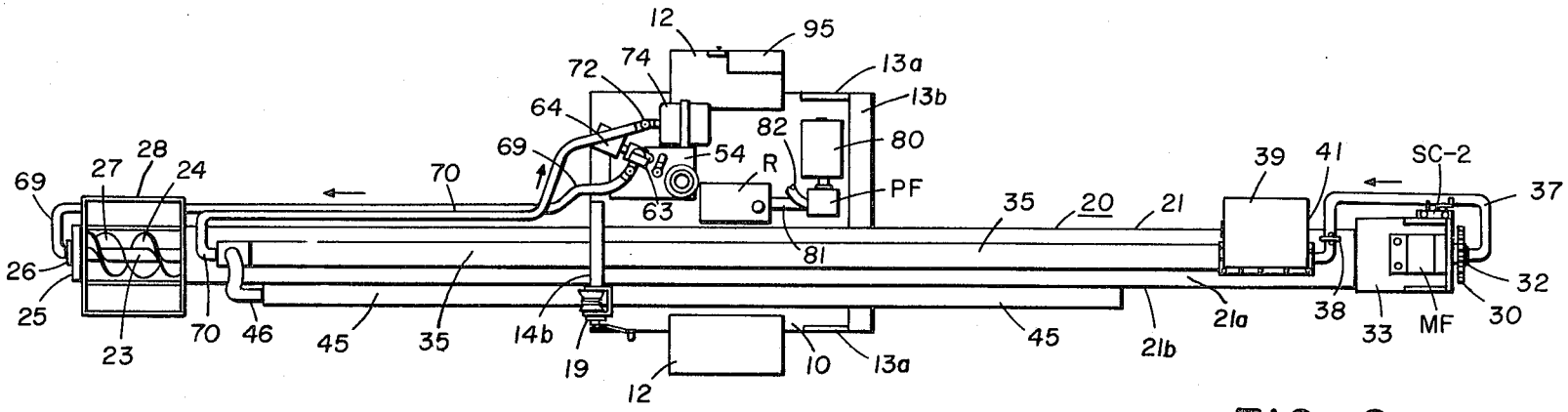
FIG. 2 is a top plan view of the grain dryer of FIG. 1.

The operation of the dryer will be largely apparent from the foregoing. The dryer is wheeled into position adjacent the bin for which it is to be used and the auger assembly 20 inclined by releasing the winch 19. The bin auger 90 is located beneath the chute 29, all as shown in FIG. 1, and powered by connection to the hydraulic lines 93 and 94. The furnace 54 is supplied with propane through the line 55 and its boiler filled with a suitable water-glycol mixture (for antifreeze purposes) through the pipe 56 up to a pressure of about 12 psig cold. A source of electric power is connected into the box 95 and the furnace 54 started, its thermostatic control 67 being set at about 240° F. When the water is up to temperature, the water pump motor 64 is started and the flow through the auger shaft 23 and duct pipe 36 previously described continued until the auger 22 and pipe 36 are also up to temperature, the working pressure of the system being about 18 psig. The blower motor 40 and the hydraulic pump drive motor 80 are turned on and the speed of the augers 22 and 90 adjusted by the controls SC-1 and SC-2. When all is ready, grain to be dried is fed into the hopper 28 and carried up the auger housing 21 by the hot auger 22. As moisture is thereupon expelled from the grain, the air supplied by the blower 39 and heated in the duct 35 by the pipe 36 passes out through the hose 46 into the duct 45 and thence through the ports 48 into the auger housing 21. The hot air thereupon passes through the grain, entraining the moisture expelled therefrom, and exits with the moisture through the ports 50 along the bottom of the auger housing 21, the dried grain finally discharging through the chute 29 into the bin auger 90 and thence the bin (not shown).

The speed of the auger 22 is of course determined by the amount of moisture in the grain. The less moisture the faster the auger 22 can operate, up to a speed of about 40 revolutions per minute. Typical water and air temperatures at various points on the prototype drier illustrate its effectiveness and efficiency, especially compared to customary grain dryers now in use. During an actual grain drying run, for example, the water temperature entering the auger shaft 23 at the coupling 25 was about 230° F. as was also the temperature of the auger flighting 24 adjacent the hopper 28. About one-third the way up the housing 21 the auger temperature was about 200° F. The water leaving the duct pipe 36 and entering the return hose 70 to the furnace 54 had dropped to 185° F. The air, in turn, after heating by the pipe 36, had a temperature of about 180° F. as it passed through the hose 46 into the duct 45 and thence into the auger housing 21 and the grain. Note that the residual heat of the water after it has heated the air in the duct 35 is not wasted since it is then returned to the furnace 54 through the hose 70 for recirculation. All this resulted in reducing the moisture content of the grain involved from about 18% to about 13%, the grain having been relatively dry to start with, at a rate of about 35 to 40 bushels per hour. Investigation later determined that the welding of the auger flighting 24 to the auger shaft 23 was very "spotty" so that the heat transfer from the latter to the former was poor. With proper adhesion between the two it is reasonable to expect capacities in the area of 100 bushels per hour. Even so, fuel consumption was only about one-third of that of current grain dryers of similar capacity.

The efficiency of the dryer could probably be still further increased by insulating the exterior of the auger housing 21. Furthermore, the heat exchange between the duct pipe 36 and the air could also be increased by equipping the pipe 36 with fins or employing some other, more elaborate form of heat exchanger. In any event, therefore, though the present invention has been described in terms of a particular embodiment, being the best mode known of carrying out the invention, it is not limited to that embodiment alone. Instead, the following claims are to be read as encompassing all adaptations and modifications of the invention falling within its spirit and scope.

We claim:

1. In grain drying apparatus including an auger having a hollow auger shaft carrying the auger flighting in heat conductive relationship to the auger shaft; an elongated auger housing, the auger being disposed within the auger housing and drivable for rotation therein about its axis; and a grain inlet into and a grain outlet from the auger housing, rotation of the auger being effective to move grain introduced into the grain inlet through the auger housing and to discharge the same from the grain outlet, the improvement comprising: means for circulating heated liquid from a source into, through and out of the auger shaft in heat exchange therewith and the auger flighting, the liquid being effective to heat the auger sufficiently to remove moisture from grain moved by the auger through the auger housing; heat exchange means for transferring heat from liquid leaving the auger shaft to air ducted from the atmosphere, the liquid thereafter being returned to the source; means for introducing the air heated by the heat exchange means into the auger housing at locations therealong between the grain inlet and outlet effective to pass the heated air into grain moving through the auger housing and to entrain moisture removed from the grain by the heated auger; means for discharging said air and moisture from the auger housing at locations between the grain inlet and outlet; and means mounting the apparatus.

2. The apparatus of claim 1 wherein the heat exchange means includes conduit means for the heated liquid and air duct means spacedly around the conduit means and communicating with the atmosphere, the conduit and duct means being disposed exteriorly of the auger housing.

3. The apparatus of claim 2 wherein the conduit and air duct means includes a conduit and a duct extending longitudinally of and carried by the auger housing on the exterior thereof.

4. The apparatus of claim 1 wherein the heated air introducing means includes air duct means disposed exteriorly of the auger housing, the duct means receiving the heated air from the heat exchange means and discharging the same into the auger housing through a first set of spaced ports therealong.

5. The apparatus of claim 4 wherein the air duct means includes a duct extending lengthwise of and carried by the auger housing on the exterior thereof, and wherein the air and moisture discharging means includes a second set of spaced ports along the auger housing longitudinally offset from the first set of ports with respect to the auger housing.

6. The apparatus of claim 1 wherein the heat exchange means includes a first air duct spacedly around the conduit and communicating with the atmosphere; wherein the heated air introducing means includes a second air duct receiving the heated air from the first duct and discharging the same into the auger housing through a first set of spaced ports therealong, the first and second ducts being each disposed on and carried by the exterior of the auger housing along a length thereof; and wherein the air and moisture discharging means includes a second set of spaced ports along the auger housing longitudinally offset from the first set of ports with respect to the auger housing.

7. The apparatus of claim 6 wherein the heated liquid is introduced into the auger shaft adjacent an upstream end and discharged adjacent a downstream end of the auger shaft with respect to the direction of movement of grain through the auger housing.

8. The apparatus of claim 7 wherein the heated liquid discharged from the auger shaft and the air ducted from the atmosphere are respectively conducted into upstream ends of the conduit and the first duct adjacent the grain outlet and are respectively conducted from downstream ends of the conduit and the first duct adjacent the grain inlet, both with respect to the direction of movement of the liquid and the air through the conduit and the first duct.

9. The apparatus of claim 8 wherein the heated air from said downstream end of the first duct is conducted into the second duct adjacent the grain inlet.

10. The apparatus of claim 9 including air pump means carried by the auger housing adjacent said upstream end of the first duct for supplying air from the atmosphere to the first duct.

11. The apparatus of claim 10 including variable speed motor means for driving rotation of the auger, the motor means being disposed on the auger housing adjacent the grain outlet.

12. The apparatus of claim 11 wherein said source includes liquid heating and storage means.

13. The apparatus of claim 12 wherein the mounting means includes a wheeled structure carrying the liquid heating and storage means and also power means for the motor means, whereby the apparatus may be moved along the ground from location to location for grain drying purposes.

14. The apparatus of claim 13 wherein the motor means includes a hydraulic motor and the power means a hydraulic pump and reservoir.

15. The apparatus of claim 14 wherein the power means also includes means for driving rotation of another grain auger apart from the auger of the apparatus.

16. The apparatus of claims 1, 2, 3, 4, 5, 6, 7, 8, 9, 10, 11, 12 or 13 wherein the auger housing is generally "U"-shaped in cross-section and disposed with the trough of the "U" lowermost, the auger being disposed in said trough and the top of the "U" being closed over.

17. A method of drying grain comprising: moving the grain to be dried through first enclosure means; circulating a heated liquid from a source in heat exchange relation but not in contact with the grain in the enclosure means effective to heat the grain and expel moisture therefrom; passing the liquid after said heat exchange with the grain through air from the atmosphere in heat exchange relation effective to heat the air and then returning the liquid to the source; passing the air after said heat exchange with the liquid into the grain in the enclosure means to entrain moisture expelled from the grain by said heat exchange between the liquid and the grain; and removing said air and moisture from the enclosure means.

18. The method of claim 17 wherein the liquid after said heat exchange with the grain and the air from the atmosphere are together passed through second enclosure means in said heat exchange relation between the liquid and the air.

19. The method of claim 17 wherein the air from the second enclosure means is passed through third enclosure means communicating with the first enclosure means effective to pass the air into the grain in the first enclosure means at locations along the passage of the grain through the first enclosure means, the first enclosure means communicating with the atmosphere at locations along the passage of the grain therethrough effective to provide for said removal of air and moisture from the first enclosure means.

20. The method of claims 17, 18 or 20 wherein the first enclosure means includes an auger housing and an auger disposed within the housing for moving grain through the housing, the auger having a hollow auger shaft for passage of the heated liquid therethrough.

* * * * *